United States Patent [19]

Post et al.

[11] Patent Number: 4,807,513

[45] Date of Patent: Feb. 28, 1989

[54] STRAIGHT BREECH FOR AN AUTOMATIC GUN BARREL WEAPON, IN PARTICULAR A MACHINE CANNON

[75] Inventors: Lothar Post, Duesseldorf; Bernhard Schneider, Moenchengladbach, both of Fed. Rep. of Germany

[73] Assignee: Rheinmetall GmbH, Duesseldorf, Fed. Rep. of Germany

[21] Appl. No.: 468,169

[22] Filed: Feb. 9, 1983

[30] Foreign Application Priority Data

Feb. 11, 1982 [DE] Fed. Rep. of Germany ..... 3204722

[51] Int. Cl.[4] ..... F41D 3/06

[52] U.S. Cl. ..... 89/11; 89/187.01

[58] Field of Search ..... 89/9, 11, 187 R

[56] References Cited

U.S. PATENT DOCUMENTS 3,648,561 3/1972 Stoner ..... 89/11

FOREIGN PATENT DOCUMENTS 491839 6/1919 France ..... 89/9

*Primary Examiner*—Stephen C. Bentley

*Attorney, Agent, or Firm*—Klein & Vibber

[57] ABSTRACT

An improved ammunition feed and guide mechanism for an automatic gun barrel weapon such as an automatic machine cannon. This mechanism includes a breech mechanism mounted in a housing. The breech mechanism includes a breech body driven by a pair of rollers rotatably mounted in the housing parallel to the middle longitudinal axis of the housing. Each roller has a driving ramp disposed on its periphery and the breech body is provided with a pair of roller bearings respectively engaging the driving ramps of the rollers so that the breech body is linearly reciprocated between loading and firing positions via the rotation of the rollers and the engagement of the roller bearings in the driving ramps thereof. The pair of rollers are driven by means independent of the propulsion energy of the fired projectiles. When the breech body is in the firing position, the roller bearings and driving ramps are maintained substantially free from the influence of the axially acting recoil forces brought to bear on the breech body during firing.

5 Claims, 4 Drawing Sheets

EXTERNAL DRIVE

STRAIGHT BREECH FOR AN AUTOMATIC GUN BARREL WEAPON, IN PARTICULAR A MACHINE CANNON

BACKGROUND OF THE INVENTION

The invention relates to a feed and guide mechanism which is rigidly secured to a linearly moving breech mechanism of an automatic gun barrel weapon.

Such type of feed and guide mechanisms is already known and described in U.S. Pat. No. 4,167,888. In this known automatic weapon with external drive motor there is provided a gun barrel whose axis is fixed with respect to a breech casing. A cartridge chamber is disposed rearwardly of the gun barrel and is adapted to coact with a breech mechanism. A rotary drum, whose peripheral surface has helical grooves forming a drive ramp of closed contour, is mounted in the breech casing. A follower member cooperates with the drive ramp and is rigidly connected to the breech mechanism. The arrangement includes two rods disposed above the rotary drum parallel to the longitudinal gun barrel axis and serve for guiding the breech mechanism in a nonuniform manner for counter recoil and recoil movements. The follower member is constructed as a rotatable plate mounted on the breech mechanism, which supports in a plane two rotatable rollers for coaction with the drive ramp disposed on the rotary drum. There are disposed on this plate at least two flat guide surfaces for the alternate coaction with at least one also flat guide surface disposed on the housing or breech casing. Thereby the two rollers mounted on the plate are specifically aligned in the cross-over region of the control groove so that the follower can traverse without malfunctioning. The rotary drum carries out a firing cycle in n revolutions, whereby n is at least equal to 3, but advantageously is equal to 4. Thereby there results n−1 cross-over regions for different branches of the drive ramp.

This known arrangement has the following drawbacks:

It requires first of all a considerable height in view of two cross-over regions per firing cycle. An additional guiding in the housing is required on corresponding sections of the breech path for the plate which is rotatably mounted on the breech body. Consequently, a mounting adjustment in a delayed manner is necessary. Additionally the feed forces are introduced via the support shaft of the plate unilaterally into the breech mechanism and, as a result of the ensuing increased wear caused by friction, malfunctioning may occur. Finally, the firing bolt arranged in the breech body is disadvantageously inertially actuated and consequently must have a sufficiently large mass which is a further drawback to be considered.

SUMMARY OF THE INVENTION

It is an object of this invention to provide an arrangement of the afore-described type for an automatic weapon, which has a reduced constructional height and dimension, as compared to the prior art devices, and which is also capable of uniformly introducing the forces for moving the ammunition thereby reducing the frictional wear. Moreover, the firing motion of the firing bolt in the arrangement of the invention is independent from its moment of inertia.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

In order to take into the account the substantially mirror-symmetrical arrangement those parts which are equivalent on both sides of the plane of symmetry have been designated with identical reference numbers. Only in those instances when it serves for a better understanding of the arrangement of the invention have the corresponding reference numbers been complemented with the designation l for left and r for right.

Figures 1, 7:
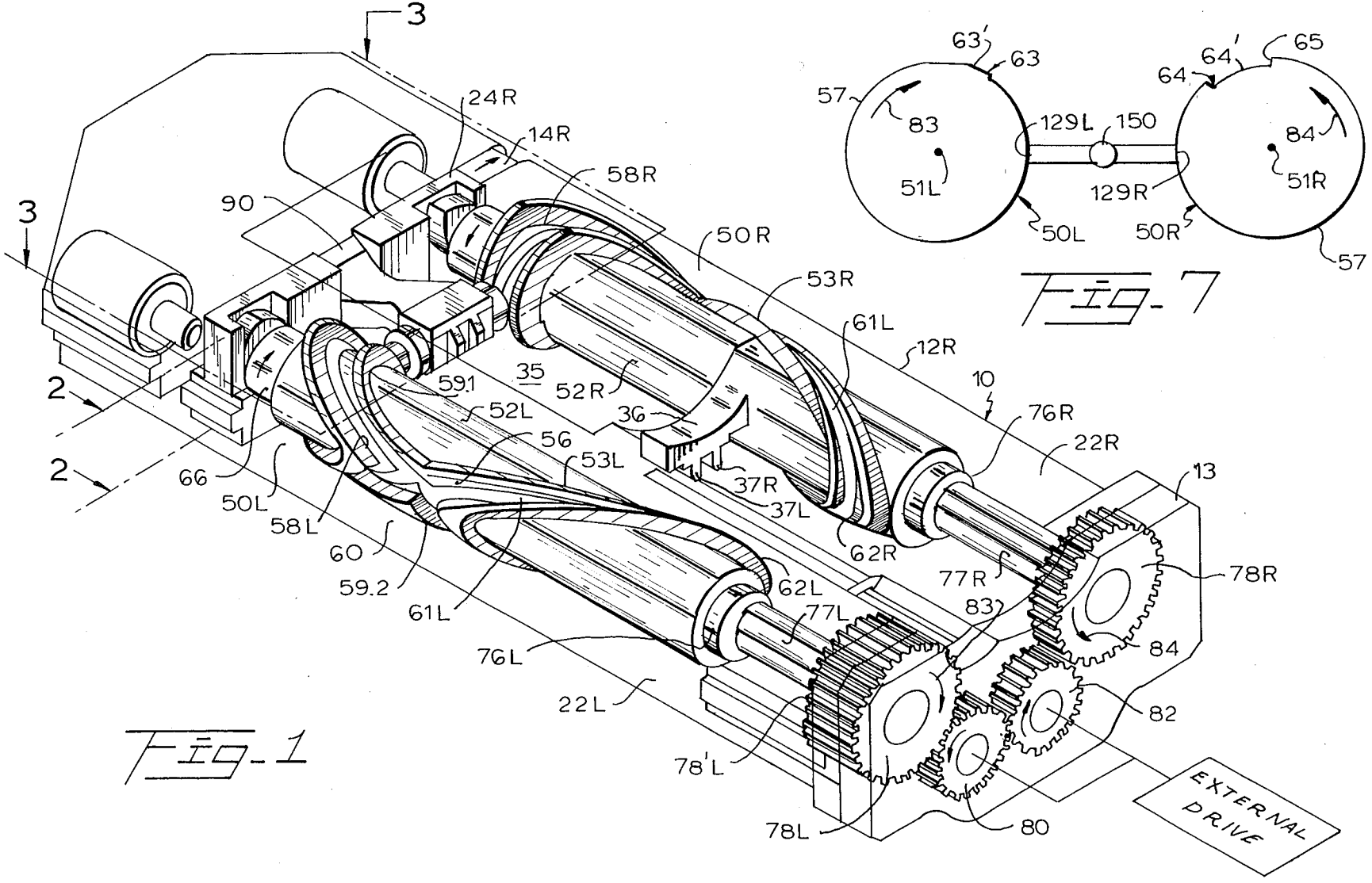
FIG. 1 is a straight breech arrangement in accordance with the invention whose controlled guidance arrangement is illustrated in perspective with cut-away portions for purpose of clarity.
FIG. 7 illustrates a diagrammatic operational sketch for illustrating more clearly the positive firing bolt guiding by means of a simplified cross-sectional sketch along the line VI—VI in FIG. 3 at a reduced scale in which insignificant details have been omitted.
Figure 3:
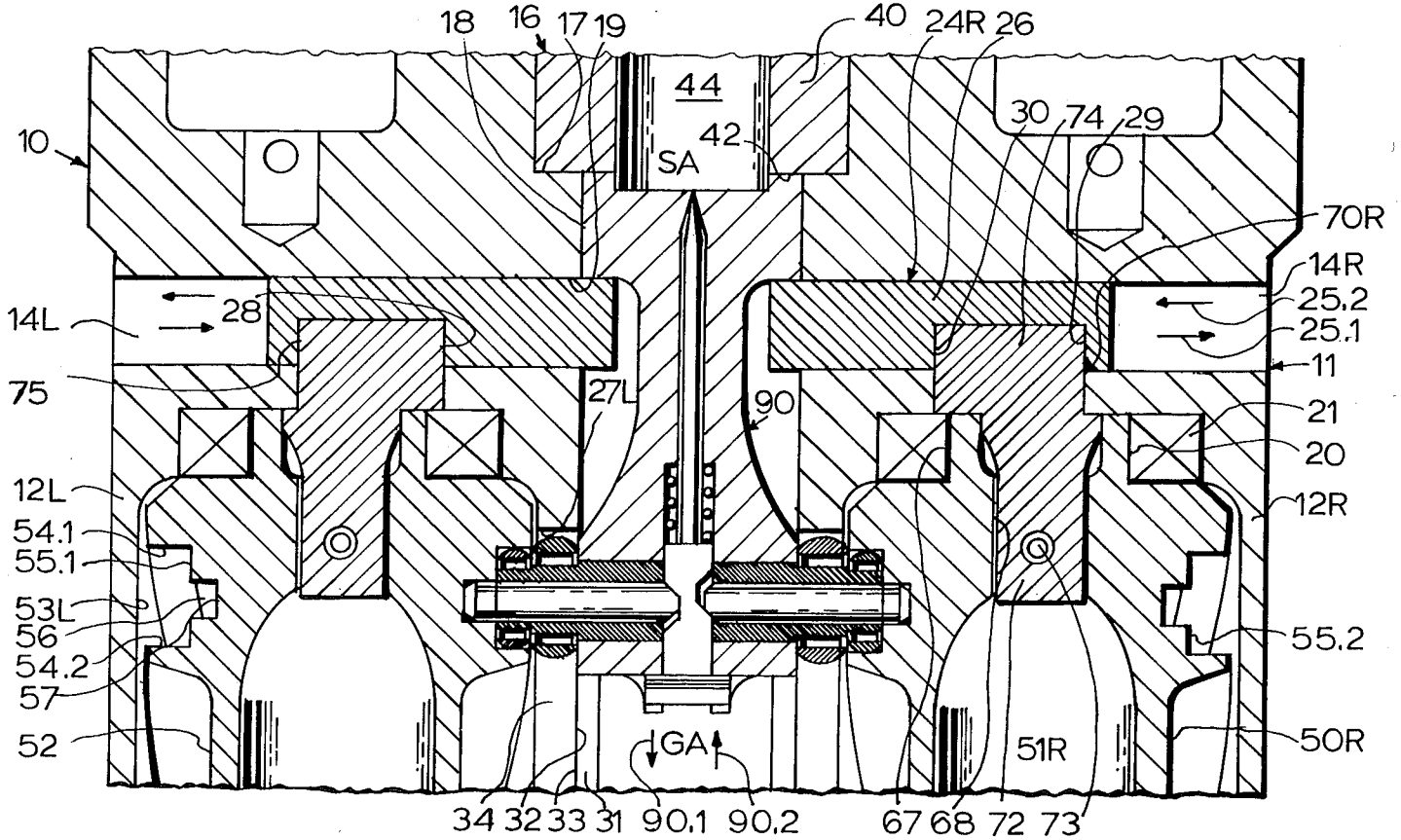
FIG. 3 is a plan cross-sectional view along the plane III—III as illustrated in FIG. 1, which plane is defined by the line III—III in FIG. 2.

Referring now to FIGS. 1 and 3, the pertinent portion of a housing 10 extends longitudinally along a middle longitudinal axis GA (which lies in the aforementioned, non-illustrated vertical plane of symmetry) between a forward support region 11 and a rear support region 13. The housing has a pair of vertical longitudinally extending side walls 12. In the forward support region 11 of the housing 10 there are disposed lateral guide grooves 14 for slidably receiving and guiding respective blocking sliders 24; respective front supports 20; and in the middle a gun barrel receiving recess 16 for a gun barrel 40 having a longitudinal gun barrel axis SA. Moreover, the gun barrel recess 16 is provided with a rear end surface 42 and a loading chamber 44. A left transverse surface **17*l* and a right transverse surface 17*r* are adjoined by guide surfaces 18*l*, 18*r* which are parallel to the afore-mentioned vertical symmetrical plane. These guide surfaces 18*l*, 18*r* are limited at their rear by corresponding edges 19 which in turn limit forwardly the guide recesses 14. The front support 20 is mounted in a friction-reducing support element 21 and receives a rearwardly extending stub shaft 66; the front support 20 has a peripheral cylindrical bearing support surface 67 which coacts with support element 21 and which extends from the main portion of a cylindrical roller 50*l*, 50*r* which roller has a central rotational axis 51*l*, 51*r*. The gun barrel longitudinal axis SA, the housing middle axis GA and the rotational axis 51*l*, 51*r*** are parallel to each other.

Figure 2:
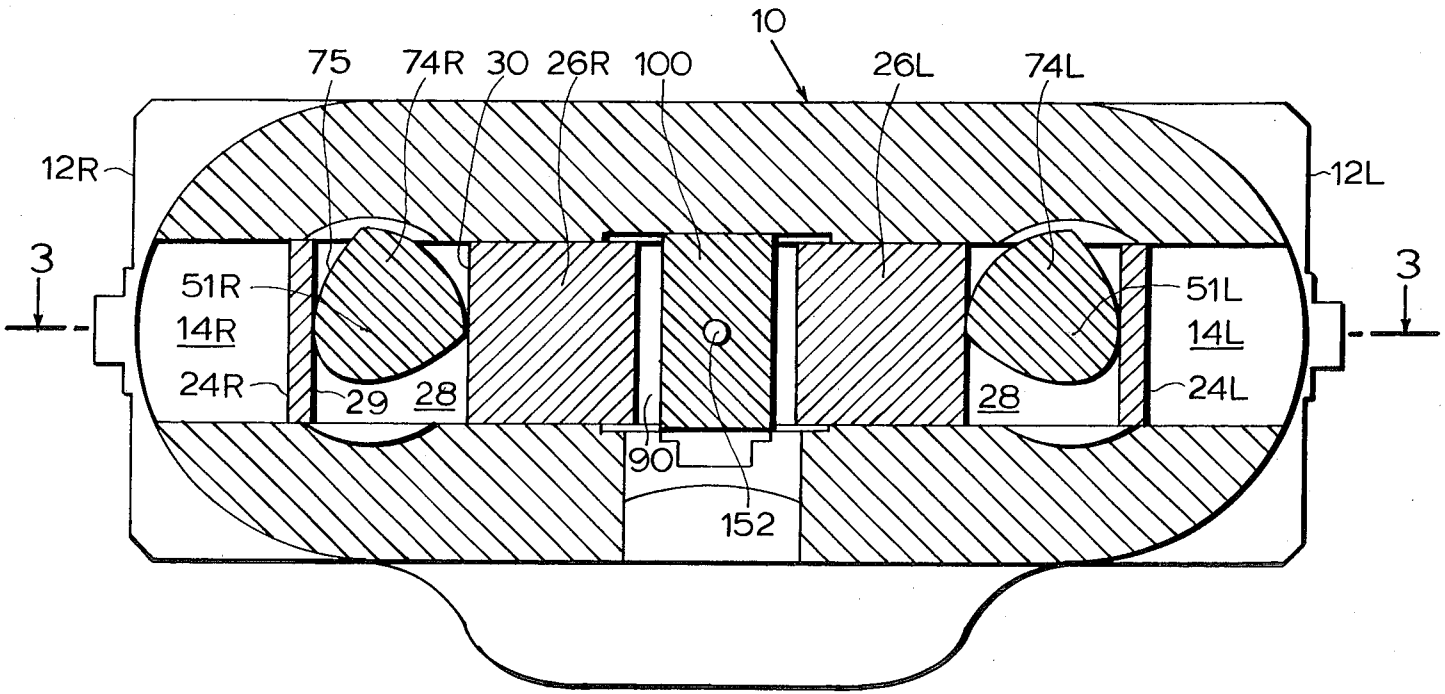
FIG. 2 is a cross-sectional view along plane II—II in FIG. 1, wherein the illustration is at an enlarged scale.

A predetermined cam groove (also referred to as driving ramp) is disposed in the peripheral region of the roller 50 which is in the form of an endless entraining groove 53 having a first entraining surface 54.1 and a second, corresponding radial entraining surface 54.2. To these surfaces there are adjoined from below at a right angle a first lateral surface 55.1 and a second lateral surface 55.2. Not further designated edges of the lateral surfaces 55 define a central guide control groove 56 which has a rectangular cross-section with a bottom surface 57. The entraining groove 53 and the thereto joined guide groove 56 merges into a forward region 58 of the entraining groove (which extends transverse to the rotational axis 51 at an angle of 90 degrees) which forward entraining groove region 58 in the region of the front support 20; this entraining groove 53 has also a rear region 62. The forward entraining groove region 58 and the rear entraining groove region 62 are joined to each other by the groove branches 59 and 61. This joining of the end regions 58 and 62 of the entraining grooves by means of the branches 59 and 61 is effected in a mutually opposite sense by a mutual cross-over in a cross-over region 60, whereby the right-hand screw direction of one branch on the roller **50*l* corresponds to the left-hand screw direction of the corresponding branch on the roller 50*r* (and conversely). As will be described hereinafter with greater particularity, the width of the forward entraining groove region 58 of the entraining groove 53 and the guide groove 56 disposed therein are larger than in the remaining extent of these grooves. The roller 50 is in the region of its stub shaft 66 provided with a central axial receiving bore 68 for receiving a rearwardly extending pin of a element 70 in the receiving bore 68 in a predetermined position by form-locking means of a locking element 73. The constant-diameter-eccentric-projection 74 engages in a control recess 28 (see FIG. 2) which is laterally defined by parallel, vertical control surfaces 29 and 30 for coacting with the peripheral surface 75 of the constant-diameter-eccentric-projections 74. The control surface (inner) 29 of the recess 28 is in contact with the projection 74. In the direction of the housing middle axis GA there is slidably mounted in the guide recess 14 a rear adjusting member 26. On the rear peripheral support surface 76 of the roller 50 there is provided in the housing 10 a rear bearing support surface 22; the latter is not illustrated in detail and its position is only referred to by means of a reference line and arrow and reference number. Past the rear support surface 76*l*, 76*r* there extends a shaft 77*l*, 77*r*, which in the region of its not further designated free end, in a manner not illustrated in detail is rotatably supported in the rear support region 13 of the housing 10, and on which there is respectively coaxially mounted a gear wheel 78*l*, 78*r*. The wheel 78*l* has a larger rim width 78'*l* which meshes with a toothed gear wheel of a non-illustrated auxiliary driving arrangement, arranged outside the housing 10, which is fed with a source of energy not forming part of the weapon (which will be described hereinafter). In addition thereto the gear wheel 78*l* meshes with an intermediate gear wheel 80 and, via the latter and an intermediate gear wheel 82 meshes with the gear wheel 78*r* in a form-locking manner. A straight breech body guide arrangement is provided which has a a pair of first horizontal support rails 31, equally spaced from respective side of the adjoining roller and the common middle housing axis GA, each rail 31 of which extends longitudinally through the housing 10 and slidably supports the breech body 90 so as to provide a straight breech body guiding. The guide rails 31 are adjoined on their exterior side by vertical upwardly extending bearing surfaces 32**. A further horizontal guide rail is not illustrated for reason of clarity but is in the herein following portion of the specification mentioned.

Figure 4:
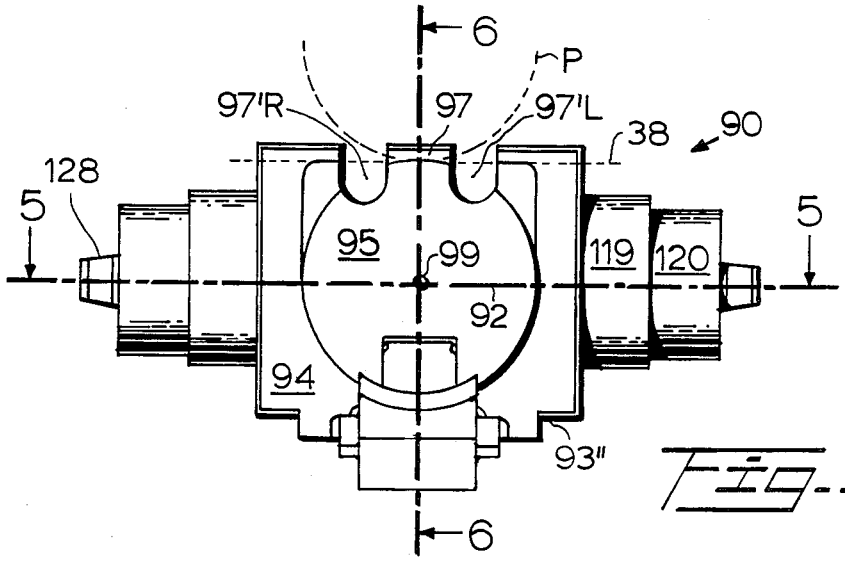
FIG. 4 illustrates a breech body illustrated in a front elevational view at an enlarged scale.
Figure 5:
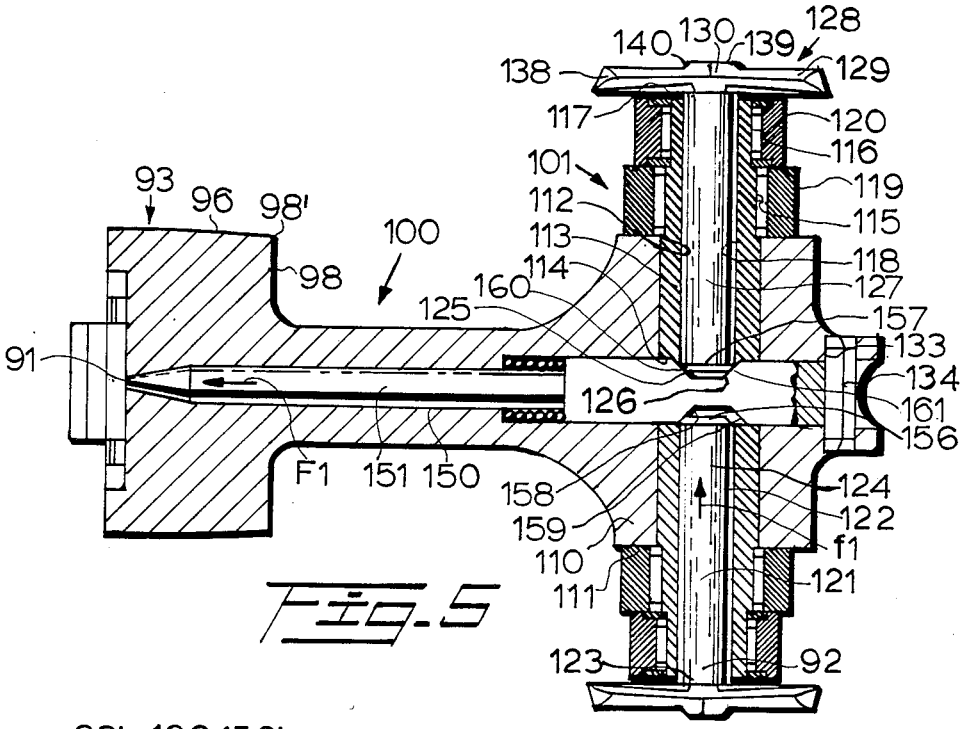
FIG. 5 illustrates the breech body in cross-section along line V—V in FIG. 4.
Figure 6:
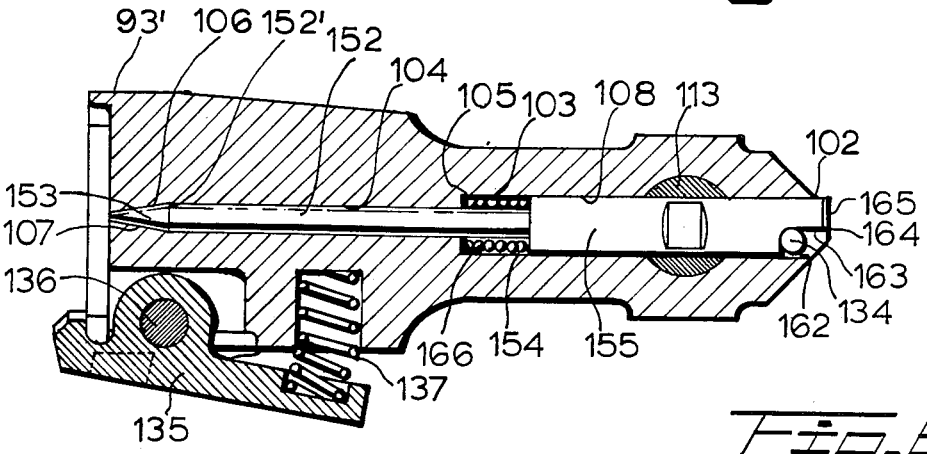
FIG. 6 illustrates the breech body in cross-section along VI—VI in FIG. 4.

There is illustrated in FIG. 1 a rigidly secured (on the housing) cartridge casing expeller 36 having a left and a right correspondingly downwardly extending finger **37*l* and 37*r* which extends towards the breech body guide arrangement. In the region of the upper side of the housing 10 there is provided a non-illustrated cartridge feed (driven with an external source of energy relative to the weapon). Coacting with this ammunition feed arrangement is a feed surface 38 which will be described hereinafter This feed surface is illustrated in FIG. 4 by means of a dash line as is illustrated a cartridge P by means of a circular dash line. Between the two support rails 31*l* and 31*r* there is disposed in the region below the cartridge casing expeller 36 a cartridge ejector 35. The breech body 90 is arranged for longitudinal axial movement within the housing 10. This breech body 90 extends along a longitudinal axis 91 from a head 93 via a middle portion 100 to a rear portion 101 and a tail edge 102 of the rear portion 101. The head 93 is substantially defined by a corresponding spherical upper side 93' and under side 93'' and a forward end middle surface 95 and again corresponding spherical left and right side surfaces 96*l* and 96*r*. In the forward end edge region 94 there is arranged, upwardly and in the middle between two ejection recesses 97*l'* and 97*r'*, an introduction finger 97. In the ejection region of the longitudinal axis 91 in the end middle surface 95 there is disposed a hereinafter to-be-described firing bolt passage 99. The side surface 96*l* and 96*r* limit a corresponding shoulder 98*l*, 98*r*, extending transversely to the longitudinal axis 91, which merges inwardly with the middle portion 100, which integrally connects the head 93 with the rear portion 101. This rear portion 101 includes a left arm 110*l* and a right arm 110*r*, both of which extend laterally and each of which is defined peripherally by a spherical surface 111. Rearwardly the rear portion is limited by the aforementioned rear edge 102. A central longitudinal bore 103 extends along the longitudinal axis 91, which bore has a stepped inner diameter and includes a forward frusto-conically shaped portion whose inner rear extent is defined by a rear edge 106. This rear edge 106 is adjoined by a forward bore region 104 having an inner diameter $d_1$. The stepped bore is provided by means of an annular portion 105. Adjoining this annular portion is a rear region 108 of the central bore 103 which has an inner diameter $d_2$ which is larger than $d_1$ (the diameter of the forward region 104 of the bore 103). A cross bore 112*l*, 112*r* crosses at an angle of 90 degrees central bore 103, which cross-bore at its opposite ends passes through the two end faces 111*l* and 111*r*. Each cross bore 112 extends along a transverse axis 92 and accommodates therein a bearing cylinder 113 which has an inner end face 114 disposed in the cross-over region between the cross bore 112 and the central bore 103. Each bearing cylinder 113 extends past the corresponding spherical end face 111 and has immediately adjacent to the end face 111*a* bearing surface 115 for supporting a guide roller bearing 119. Adjoining the bearing surface 115 is an outer bearing surface 116 for supporting a second entraining roller bearing 120, whereby the outer diameter of the second roller bearing is smaller than that of the first guide roller bearing 119. The bearing surface 116 extends up to an end face 117 of the bearing cylinder 113. A second cross-bore 133 extends parallel to the transverse axis 92 adjacent to the rear edge 102 which transverse bore 133 crosses the rear region 108 of the central bore 103 at an angle of 90 degrees and which receives therein a tightening pin 134. There is movably mounted in the central bore 103 a firing pin or bolt 150 having a longitudinal axis 151 which is adapted for axial movement within the central bore 103. A rear control portion 155 of the bolt 150 is disposed in the rear region 108 of the central bore 103 and has an exterior diameter which mates with the interior diameter $d_2$ of said rear region. This rear portion of the firing bolt 150 is limited at its forward extent by means of an annular portion 154 which is disposed at a predetermined axial distance from the annular portion 105 of the central bore 103 and is transversely disposed with respect to the longitudinal axis 151**.

The annular portion 154 is adjoined by the forward shaft portion 152 (whose outer diameter corresponds to the inner diameter $d_1$ of the forward region 104 of the central bore 103) and extends forwardly up to an edge 152' at which edge the forward shaft 152 merges into the frusto-conical nose portion 153. Near the rear end of the rear control portion 155 there is disposed a recess 162 which includes a guide surface 163 being limited by a common edge 164 with an end face 165. A spiral holding spring 166 surrounds the forward shaft 152 and abuts with its respective ends against the annular portions 105 and 154. By pre-compressing the holding spring 166 the firing bolt 150 is maintained in an inoperative position by the tightening pin 134 and its coaction with the guide surface 163 and the bolt 150 is also secured against rotation in this way. In its inoperative position a left recess 156 and a right recess 157 of the rear control portion 155 is positionally adjusted in a predetermined manner with respect to the corresponding cross bores **112*l* and 112*r*. The recess 156 is limited by a forward edge surface 158 and a rearward edge surface 159. The recess 157 is limited by a forward edge surface 160 and a rear edge surface 161. The corresponding counter surfaces 158 . . . 161 are formed as vertical prism surfaces, whereby they encompass pairwise with each other and individually with a vertical plane which includes the longitudinal axis 151 a corresponding acute angle. The recess 156 is arranged to the left and the recess 157 is arranged to the right with respect to the longitudinal axis 151, whereby the recess 157 is displaced relative to the recess 156 by a predetermined axial distance in the direction of the annular step 154. An inner bore surface 118 of the bearing cylinder 113 surrounds a control bolt 124 adapted to coact with a control support shaft 121, both of which have circular cross-sections and are movably arranged within the bearing cylinders 113. The control bolts 124*l*, 124*r* coact with their control surfaces 125 and 126 in the recesses 156, 157. The control surfaces 125 and 126 are also formed as prismatic vertical surfaces for purposes of coacting with the corresponding counter surfaces 158 and 159 respectively 160 and 161. The control bolt 124 with the end 127 thereof which is remote from the firing bolt 150 contacts the control support member 121, whereby one or both ends 122, 127 of the bolt 124 and shaft 121 has preferably a spherical shape. At the exterior end 123 of the control support shaft 121 there is secured a guide element 128. By means of the mutual arrangement of the control surfaces 125 and 126 as well as the counter surfaces 158 . . . 161 the control bolts 124 may move along a longitudinal axis 92 but cannot rotate about the same. In contradistinction thereto, the control support member 121 can rotate about axis 92 as well as move axially. This will be further described hereinafter. The guide element 128 projects past the exterior end face 117 of the bearing cylinder 113 and has a gliding skid 129 with two identical free ends, which are defined by means of deflecting surfaces 138. Via an exterior surface of the gliding skid 129, which is not illustrated in detail, the control surface 130 projects outwardly. This control surface is disposed on the transverse axis 92 and is limited by an end surface 139 and two deflecting inclines 140. The length of the gliding skid 129 is larger by a predetermined amount than the exterior diameter of the immediately adjacent entraining roller bearing 120. The breech body 90 rests with the exterior regions of its spherical underside surface 93" on the support rails 31. For guiding the exterior region of the spherical or round upper side surface 93' one of the support rails 31*l*, 31*r* is adapted to coact with the breech body 90** over which rail it is disposed at a vertical distance parallel to the breech body, which rail is, as has been stated herein-above, for purpose of clarity not illustrated in detail.

This breech body is laterally, in the region of its round side surfaces **96*l* and 96*r* and the round or spherical guide end faces 111*l* and 111*r* guided along the bearing surfaces 32*l* and 32*r*. The breech body 90 rests with its guide roller bearings 119*l*, 119*r* on the track or rail 34*l* and 34*r*. The entraining roller bearing 120*l* and 120*r* engage in the entraining groove 53*l* and 53*r* and the guide elements 128*l* and 128*r* engage in the control guide grooves 56*l* and 56*r***.

MANUAL OF OPERATION

In the initial starting condition for the operation of the arrangement the breech body 90 is in its forward end position and engages with its guide elements into the guide control groove 56 in the roller 50 so that its entraining roller bearing 120 is disposed in the entraining groove 53 in its forward end position region **58*l* and 58*r*, as is illustrated in FIGS. 1 and 3. No cartridge P is disposed in the feed plane 38 over the middle of the feed position. The non-illustrated auxiliary external driving arrangement which is driven by an external source of energy, drives the gear wheel 78*l* for rotating the roller 50*l* in the clockwise direction (arrow 83) and the roller 50*r* in the counter-clockwise direction (arrow 84). The driving arrangement is also operatively connected with the cartridge feeder, whereby between the latter and the rollers 50*l*. 50*r* a positive drive is furnished. As a result of the afore-described rotation of the rollers the blocking sliders 24*l* and 24*r* are adjusted in the direction of the arrows 25.1 (FIG. 3) and expose the shoulders 98*l* and 98*r* on the breech body 90. The entraining roller bearings 120*l* and 120*r* arrive in the corresponding entraining groove branch 59.1 and by way of the mutual positive drive connection there results an axial movement of the breech body 90 in the direction of an arrow 90.1 (see FIG. 3). The guide element 128, which is rotationally mounted via the control support member 121 in the bearing cylinder 113, follows the course of the guide groove 56 with the aid of the entraining roller bearing 120 while continuously adapting itself to the angularity with respect to the rotational axis 51. When entering into the cross-over region 60 the length of the gliding skid 129 engenders a well-defined transfer of the entraining roller bearings 120*l*, 120*r* from the branch 59.1 into the branch 59.2 of the entraining groove 53. In the meantime the positively step-wise controlled cartridge feeder (not illustrated) feeds in a feed step a cartridge P into the cartridge feed plane 38 (see FIG. 4) over the middle of the arrangement into the feed position and during the further recoil of the breech body 90 the ejection fingers 37***l* and 37*r* pass through the recesses 97'*l* and 97'*r*, so that a non-illustrated empty cartridge casing looses a positive linkage with the breech body 90, provided at the bottom side by means of the extractor 135 and falls through the cartridge casing ejector 35. During the continuous further rotation of the rollers 50*l* and 50*r* the breech body 90 arrives in its rearward end position, in which the entraining rollers 120*l* and 120*r* and the guide elements 128*l* and 128*r* are arranged on the rearward end support region 62*l*, 62*r* of the entraining groove. The guide elements 128*l*, 128*r* follow the course corresponding to that of the central guide groove 56 and for purposes of reversing the movement of the breech body 90 are positioned in a vertical transverse position relative to the rotational axes 51*l*, 51*r*. The control bolt 124 retains its position, that means it does not rotate. For the purpose of reversing the movement of the breech body 90 in the direction of an arrow 90.2 the positive connecting means of the breech body 90 arrives in the corresponding branch 61.1 of the grooves disposed on the rollers 50. During the further forward movement of the breech body 90 its introducing finger 97 arrives at the bottom of the cartridge P located in the plane 38 and entrains it until it is introduced into the loading chamber 44. As the breech body 90 approaches its forward end position, the blocking sliders 24*l* and 24*r* are moved by means of the adjusting controlling motion of the equal-diameter-projections 74*l* and 74*r* in the direction of a corresponding arrow 25.2 towards the housing middle axis GA.

As soon as an edge 98' of the shoulder 98 passes the edge 19 of the corresponding guide surface 18 and thereby the breech body 90 has reached its forward-most end position (with which the forward end position region 58 of the entraining groove 53 coacts) and the corresponding cartridge P is fully introduced into the loading chamber 44, the blocking sliders 24*l* and 24*r* move into a blocking position, and at the further rotation of the rollers 50*l* and 50*r* the shoulders 98*l* and 98*r* are rigidly locked in place. (In contradistinction to the rear-most end position region 62 of the entraining groove, which serves only for the reversal of motion of the breech body 90, the forward end position region 58 is provided with a larger rotational angle for the corresponding roller 50*l*, 50*r*, whereby the entraining groove 53 and the central guide control groove 56 cross the rotational axis 51 at an angle of 90 degrees). The guide elements 128*l* and 128*r* find themselves again in a vertical transverse position. During the further rotation of the rollers 50*l* and 50*r* (see FIG. 7) the firing cam 63 approaches the gliding skid 129*l* on the bottom surface 57 of the control guide groove 56*l*; the offset depression 64 in the bottom surface 57 of the guide groove 56*r* approaches the gliding skid 129*r*. When the firing cam 63 and the offset depression 64 have reached the corresponding gliding skids 129, the following operation is positively initiated: the firing cam 63 presses the gliding skid 129*l* away from the bottom surface 57. As a result thereof the control support member 121*l* makes an axial movement in the direction of the arrow $f_1$ and forces the control bolt 124*l* to make an equivalent motion, also towards the longitudinal axis 151 of the firing bolt 150. The resulting motion of the forward control surface 125*l* relative to the counter-surface 158 introduces via the latter into the firing bolt 150 an axial force component in the direction of the arrow $F_1$ whereby the counter-surface 161 moves relative to the rear control surface 126*r* of the control bolt 124*r*. Thereby there results a force component for axial movement of the control bolt 124*r* in the direction of the arrow $f_1$, by means of which the control support member 121*r* with its control surface 130*r* can be deflected into the deflecting recess 64. The axial movement in the direction of the arrow $F_1$ of the firing bolt 150 permits the frusto-conical nose portion 153 to penetrate through the firing bolt opening 99 to ignitingly penetrate into a propellant charge fuse of the cartridge in the loading chamber 44. A firing then occurs. While the gliding skid 129*l* is in contact with the cam surface 63' of the firing cam 63, the firing bolt 150 is positively maintained in its forward igniting position. By means of a sufficient angular traverse of the rotational movement the rigid locking duration can be predetermined and thereby a possible ignition delay can be taken account of and be safe-guarded against.

During the duration of the rigid locking all those forces which are produced on the breech body 90 by the propellant gas pressure during firing in the direction of the arrow 90.1 (FIG. 3) acting via the blocking sliders 24*l* and 24*r* on the housing 10 and thereby they are kept away from the entraining rollers 120*l* and 120*r*, the entraining surface 55.2, as well as the guide elements 128*l* and 128*r*, as well as the central control guide groove 56*l* and 56*r*. For sake of security there is, however, as has been previously mentioned, maintained in the corresponding section of the forward entraining groove end region 58 an axial distance between the entraining surfaces 54.1 and 54.2 which is larger than the exterior diameter of the entraining rollers 120, so that in this region 58 there is no mutual positive forcible engagement between rollers and grooves. Similarly, in the corresponding region the control grooves 56*l* and 56*r* have corresponding widths. The rigid locking is also, for sake of security, maintained a predetermined period of time after the cessation of the mutual contact between the cam surface 63 and the gliding skid 129*l*, on the one hand, and the gliding skid 129*r* and a surface 64', on the other hand, which means that after positively, via a control cam surface 65, the gliding skid 129*r* has again moved inwardly, counter to the directional arrow $f_1$, and thereby the firing bolt 150 is moved rearwardly counter to the directional arrow $F_1$, as well as thereby the gliding skid 129*l* with the corresponding elements (according to the afore-described ignition process in the reverse order) assume their corresponding starting positions (prior to the ignition process). During recoil and the development of the firing cycle the housing 10 moves in the direction of the arrow 90.1. Thereby also the gear wheel 78*l* moves relative to a gear wheel meshing therewith forming part of the auxiliary driving arrangement which is not mounted in the housing 10. In order to maintain during this motion the mutual driving form locking between both gear wheels, the width of the gear wheel 78*l* must be made sufficiently large. During the further rotation of the rollers 50*l* and 50*r* the afore-described function is repeated.

In comparison with the afore-described state of the art arrangement, the following advantages result from the arrangement of this invention: in view of a bilateral entraining guiding of the breech body 90, the friction contact between the entraining rollers 120 and the surfaces 54.1 and 54.2 of the entraining groove 53 as well as the friction contact between the round surfaces and the therewith coacting support rails and support surfaces as well as the constructional complexity for the (simplified) straight guiding means are reduced. By arranging the path of the breech body at the level of the rotational roller axis the total height of the arrangement in the pertinent region is substantially reduced. The positive actuation of the firing bolt 150 permits it to make its mass relatively small. The holding coil spring 166 serves exclusively for fixing the firing bolt 150 in its inoperative position and thereby avoids the undesirable relative movements of the control surfaces 125*l*, 125*r* and 126*l*, 126*r* and the counter-surfaces 158 . . . 161 and furnishes with the positive control of the firing bolt 150 its penetration into the corresponding propellant charge ignition fuse exclusively in the predetermined ignition region. A reduction of the moving mass of the breech body 90 serves also for the step to separate the blocking sliders 24*l* and 24*r* from the breech body 90 and to guide them firmly in the housing. By means of the forcible controlling of the blocking sliders 24*l* and 24*r* a premature unblocking with the ensuing well-known accompanying consequences is avoided.

Although the invention is described and illustrated with reference to a preferred embodiment thereof, it is to be expressly understood that it is in no way limited to the disclosure of such preferred embodiment but is capable of numerous modification within the scope of the appended claims.

We claim:

1. In an improved ammunition feed and guide mechanism for an automatic gun barrel weapon, in particular, an automatic machine cannon having a linearly moving breech mechanism which is driven by means of a follower engaging in a driving ramp of at least one drum rotatably mounted in a housing parallel to the longitudinal axis of the gun barrel which is drivingly connected to an external drive, said drum having a driving ramp disposed on its periphery and said breech mechanism having a breech body with a follower which drivingly engages said driving ramp so that upon rotation of said drum said breech body is non-uniformly linearly moved forwardly and rearwardly during a firing cycle along central longitudinal guiding means operatively disposed in said housing, a firing bolt is axially movably mounted in a central bore disposed in said breech body, there corresponds to each portion of the path traversed by said breech body and to each portion of the path traversed by the follower in a corresponding driving ramp a partial function within firing cycle, in particular to move said breech body into a forward end position and maintain it in said forward end position, in which it is blocked for the purpose of effecting a firing operation during a predetermined period of time, the improvement comprising in combination, (a) said drum being formed as a pair of rollers and said longitudinal guiding means include a first pair of guide rails equidistantly mounted relative to the path of movement of said breech body, which is operatively movable over said first pair of guide rails; said pair of rollers being adapted to rotate in entraining groove, a guide groove is centrally disposed in each entraining groove;

(b) said breech body having a first pair of laterally extending projecting portions, which are adapted to coact with confrontingly disposed portions of the respective entraining and guide grooves of the driving ramps o the confronting roller of said pair of rollers;

(c) a guiding element and an entraining roller bearing are operatively mounted in each on one of said first projecting portions of said breech body and are adapted to respectively engage into a confronting guide groove and entraining groove, a guide roller bearing is also operatively mounted on each first projecting portion and is adapted to guidingly ride over a corresponding one of said first pair of guide rails;

(d) a pair of blocking sliders transversely movably mounted in said housing and are adapted to move from an inoperative outer position to an operative blocking inner position in which the breech body is blocked from moving rearwardly, each roller having an axially forwardly extending projection operatively connected to each blocking slider so that each blocking slider is reciprocally moved by the rotation of the rotation of the corresponding roller;

(e) said breech body having a pair of rearwardly facing shoulders, each blocking slider, when in its inner operative position, blocking the rearward movement of the breech body by engaging a corresponding rearwardly facing shoulder of said breech body; and (f) blocking means operatively mounted in said breech body and guide elements coacting with the blocking means for moving said firing bolt into a forward firing position and rearwardly after the firing has been effected, said firing bolt being blocked in said forward and rear positions by said blocking means.

2. In an improved ammunition feed and guide mechanism for an automatic gun barrel weapon, the improvement as set forth in claim 1, wherein (a) said blocking mans comprise a left and a right control support member and a left and right control bolt which are respectively mutually aligned with each other;

(b) each control bolt has an inner free end which confronts the inner free end of the other control bolt; two control surfaces are disposed on the inner free end of each control bolt;

(c) said firing bolt having a confronting counter surface for coaction with control surface on each control bolt;

(d) each control support member and aligned control bolt are transversely axially guidingly movably mounted in one of said first laterally extending projecting portions, each control support member has a gliding skid operatively connected at its outer free end;

(e) the axial movement of one control support member and one control bolt in one first projecting portion towards said firing bolt causes the firing bolt to move forwardly in said central bore of said breech body into its firing position an causes the axial movement of the other control bolt and control support member away from said firing bolt in the other first projecting portion;

(f) the axial movement of said one control support member and one control bolt in said one first projecting portion is effected via a contacting of the corresponding gliding skid wit a firing cam disposed in the corresponding guide groove in the one roller during the travel of the skid through said guide groove;

(g) during the contacting of the skid with the firing cam in the guide groove of the one roller the skid in the guide groove of the other roller traverses an offset depression in the guide groove of the other roller;

(h) the axial movement of the other control support member and other control bolt counter to the direction of said one control support member and control bolt is introduced via the contacting of the corresponding gliding skid with an inclined cam surface in the guide groove of the other roller.

3. In an improved ammunition feed and guide mechanism for an automatic gun barrel weapon, the improvement as set forth in claim 2, wherein (a) each blocking slider of said pair of blocking sliders includes a portion which is proximate to the middle longitudinal axis of the housing and breech mechanism and which functions as a block adapted to engage the rear of a shoulder of the head of the breech body when said slider has moved to its inward position, and further includes a control recess having a first control surface proximate to the middle longitudinal axis of the breech mechanism, and a second control surface remote from said longitudinal axis;

(b) each axially forwardly extending projection having a rotatable control element the forward portion which extends into each one of said control recesses, this forward portion being eccestrically shaped relative to its axis rotation and having a plurality of cam surfaces adapted to engage said first and second control surfaces;

(c) each control element is operatively connected to a roller via said forwardly extending projection, so that the angular positioning of said control element is effected in such a way via the rotation of the corresponding roller which controls the positioning of the breech body, that when the breech body is in its most forward position, the blocking sliders have the position proximate to the middle longitudinal axis most inwardly positioned relative thereto to block the rearward movement of the breech body by engaging the rear of the shoulders of the head of the breech body; whereby (d) when the rearward movement of the breech body is so blocked the entraining roller bearings, the entraining grooves, as well as the guide elements and control guide grooves are maintained substantially free from the influence of the axial recoil forces brought to bear on the breech body during firing.

4. In an improved ammunition feed and guide mechanism for an automatic gun barrel weapon, the improvement as set forth in claim 3, including a second pair of guiding rails parallel to said first pair, wherein the surfaces of said breech body, which come into contact with said first and second pairs of guide rails, are round, curved or spherically shaped.

5. In an improved ammunition feed and guide mechanism for an automatic gun barrel weapon, the improvement as set forth in claim 4, including a coil spring coaxially mounted on said firing bolt and adapted to engage a portion thereof to thereby bias said firing bolt into its inoperative position.

* * * * *